United States Patent [19]

Wood et al.

[11] Patent Number: 4,998,899

[45] Date of Patent: Mar. 12, 1991

[54] MOORING LINE FLOTATION DEVICE

[76] Inventors: David B. Wood, 44 Knollwood Rd., Huntington, N.Y. 11743; Harold E. Wood, Jr., 20 Fairwind Ct., Northport, N.Y. 11768

[21] Appl. No.: 424,913

[22] Filed: Oct. 23, 1989

[51] Int. Cl.[5] ..... B63B 22/02

[52] U.S. Cl. ..... 441/3; 114/230; 441/133

[58] Field of Search ..... 114/230, 267; 441/1, 441/3, 133

[56] References Cited

U.S. PATENT DOCUMENTS

| | | | |
|---|---|---|---|
| 1,037,111 | 8/1912 | Bethel | 441/1 |
| 2,354,441 | 7/1944 | Diehl | 114/230 |
| 3,110,046 | 11/1963 | Fischer | 114/230 |
| 3,431,568 | 3/1969 | Brown | 441/3 |
| 3,473,505 | 10/1969 | Brown | 114/230 |
| 3,728,749 | 4/1973 | Eby et al. | 441/1 |
| 4,063,322 | 12/1977 | Tolan | 114/267 |
| 4,098,214 | 7/1978 | Ogura | 114/230 |

*Primary Examiner*—Joseph F. Peters, Jr.
*Assistant Examiner*—Jesûs D. Sotelo
*Attorney, Agent, or Firm*—Daniel Jay Tick

[57] ABSTRACT

A mooring line flotation device for maintaining a mooring line extending from an offshore structure above the surface of a body of water when the mooring line is not in use. The flotation device is a raft-like float having an open center. A buoyant bordering member is provided around the center and a perforated platform member extends across the center above the surface of the body of water when the float is afloat. A coupling device is affixed to the float for releasably affixing the float to the offshore structure in close proximity therewith, whereby a mooring line extending from the structure is supported, when not in use, by the platform member in essentially unfouled, clean, dry and readily available condition for use when desired.

16 Claims, 3 Drawing Sheets

FIG. 2
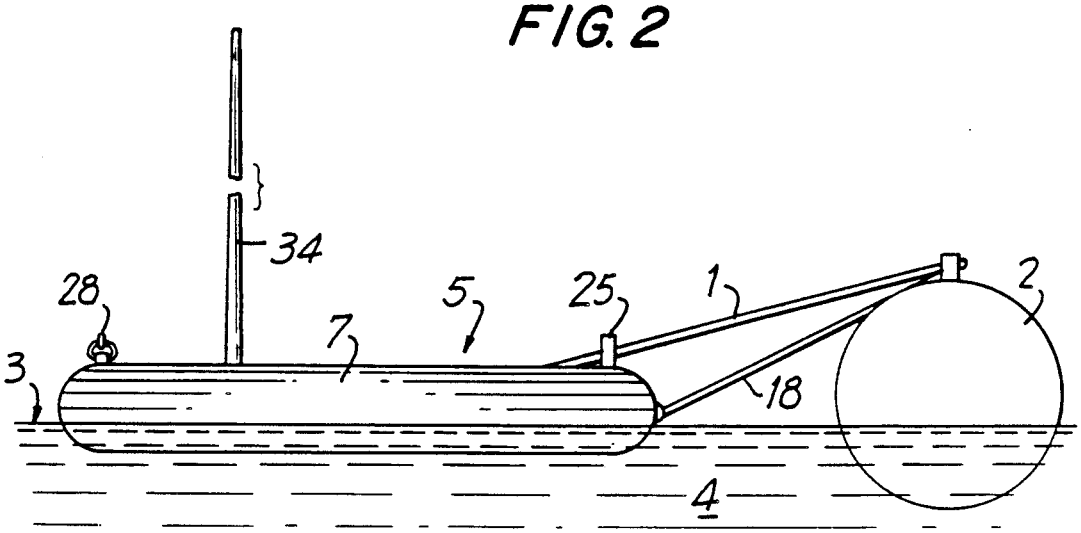
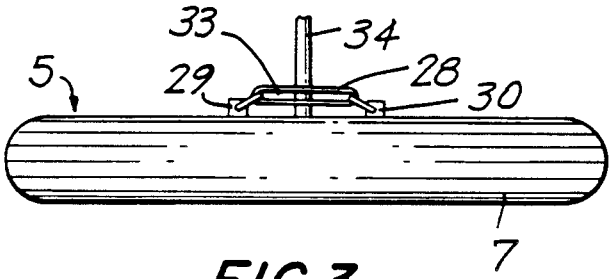
FIG. 3
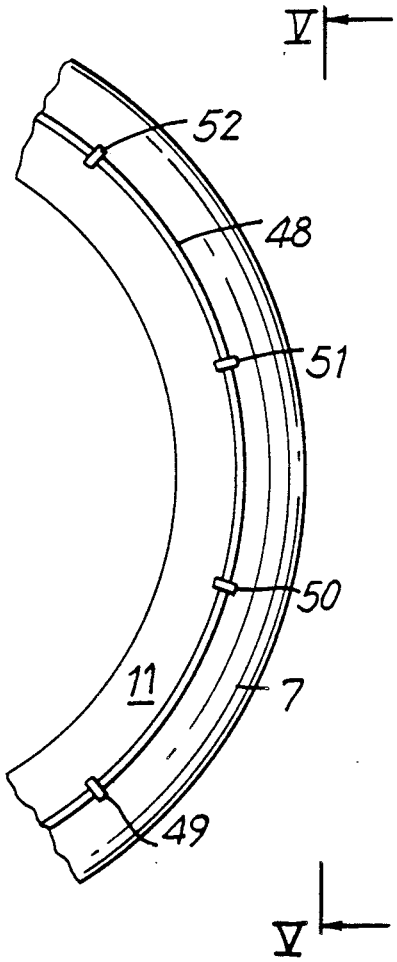
FIG. 4

MOORING LINE FLOTATION DEVICE

BACKGROUND OF THE INVENTION

The present invention relates to a boating accessory. More particularly, the invention relates to a mooring line flotation device.

If the mooring line is permitted to hang from the mooring buoy into the water, it is subjected to undesirable matter in the water and may become encrusted or fouled with various types of marine growth, grass, mud, or the like. It is desirable that a mooring line extending from an offshore mooring buoy be kept clean of marine growth, grass, mud, or the like, when it is not in use, so that it may be readily available to anyone desiring to moor a boat to such buoy. It is also desirable that the mooring line be removed from total immersion in the water thereby preventing undesired effects of said line. Furthermore, the life of the mooring line may be extended considerably if said line is kept substantially dry when it is not in use.

The principal object of the invention is to provide a mooring line flotation device of simple structure for maintaining a mooring line extending from an offshore mooring structure substantially unfouled, clean, dry and readily available for use when said line is not in use.

An object of the invention is to provide a mooring line flotation device, which is easily used and moved on land or water, for maintaining a mooring line extending from an offshore mooring structure substantially clean, dry and readily available for use when said line is not in use.

Another object of the invention is to provide a mooring line flotation device of simple structure, which is inexpensive in manufacture and is highly visible when it is in position, for maintaining a mooring line extending from an offshore mooring structure substantially clean, dry and readily available for use when said line is not in use.

Still another object of the invention is to provide a mooring line flotation device for maintaining a mooring line extending from an offshore mooring structure substantially clean, dry and readily available for use when said line is not in use, said flotation device being usable with facility and convenience by any untrained person and requiring little or no repair or maintenance.

BRIEF SUMMARY OF THE INVENTION

In accordance with the invention, a mooring line flotation device for maintaining a mooring line extending from an offshore structure above the surface of a body of water when the mooring line is not in use, comprises a raft-like float having an open center, a buoyant bordering member around the center and a platform member extending across the center above the surface of the body of water when the float is afloat. The platform member is perforated. Coupling means is affixed to the float for releasably affixing the float to the offshore structure in close proximity therewith, whereby a mooring line extending from the structure is supported, when not in use, by the platform member in substantially dry and readily available condition for use when desired.

The buoyant bordering member has an inside surface around the center, an outside surface spaced from and substantially opposite the inside surface and an upper surface extending between the inside and outside surfaces. The coupling means is affixed to the outside surface of the buoyant bordering member and the platform member encloses the center and is bordered by the inside surface.

The buoyant bordering member comprises a substantially solid buoyant material or a gas chamber and buoyant gas in the gas chamber.

Pocket means on the bordering member stores ballast. The pocket means is on the inside surface of the buoyant bordering member.

A mast is removably mounted on the bordering member and a coupling device couples the mast to the free end of the mooring line.

Lead means is mounted on the bordering member for directing the mooring line aboard the flotation device in proximity with the coupling means.

Grasping means is affixed to the bordering member for facilitating the manipulation of the flotation device and thereby the mooring line supported thereby.

Restraining means is mounted on the bordering member for preventing the mooring line from falling into the water.

Seagull roost-discouraging means is mounted on the bordering member.

In accordance with the invention, a mooring line flotation device for maintaining a mooring line extending from an offshore structure above the surface of a body of water when the mooring line is not in use, comprises a substantially annular gas chamber having an open center and a platform member extending across and enclosing the center above the surface of the body of water when the chamber is afloat. The platform member is perforated. The chamber has an inner diameter surface around the center, an outer diameter surface spaced from and substantially radially opposite the inner diameter surface and an upper surface extending between the inner diameter and outer diameter surfaces. Coupling means is affixed to the outer diameter surface of the chamber for releasably affixing the chamber to the offshore structure in close proximity therewith, whereby a mooring line extending from the structure is supported, when not in use, by the platform member in substantially clean, dry and readily available condition for use when desired. A plurality of spaced pockets on the inner diameter surface of the chamber stores ballast.

A mast is removably mounted on the chamber and a coupling device couples the mast to the free end of the mooring line.

Lead means is mounted on the upper surface of the chamber for directing the mooring line aboard the flotation device in proximity with the coupling means.

Grasping means is affixed to the upper surface of the chamber for facilitating the manipulation of the flotation device and thereby the mooring line supported thereby.

Restraining means is mounted on the bordering member for preventing the mooring line from falling into the water.

Seagull roost-discouraging means is mounted on the bordering member.

BRIEF DESCRIPTION OF THE DRAWINGS

In order that the invention may be readily carried into effect, it will now be described with reference to the accompanying drawings, wherein:

FIG. 2 is a side view, taken along the lines II—II, of FIG. 1, on a reduced scale and showing an offshore mooring buoy;

FIG. 3 is a side view, taken along the lines III—III, of FIG. 1, on a reduced scale;

FIG. 4 is a top plan view of part of an embodiment of a seagull roost-discouraging device of the invention;

DETAILED DESCRIPTION OF PREFERRED EMBODIMENT

Figure 1:
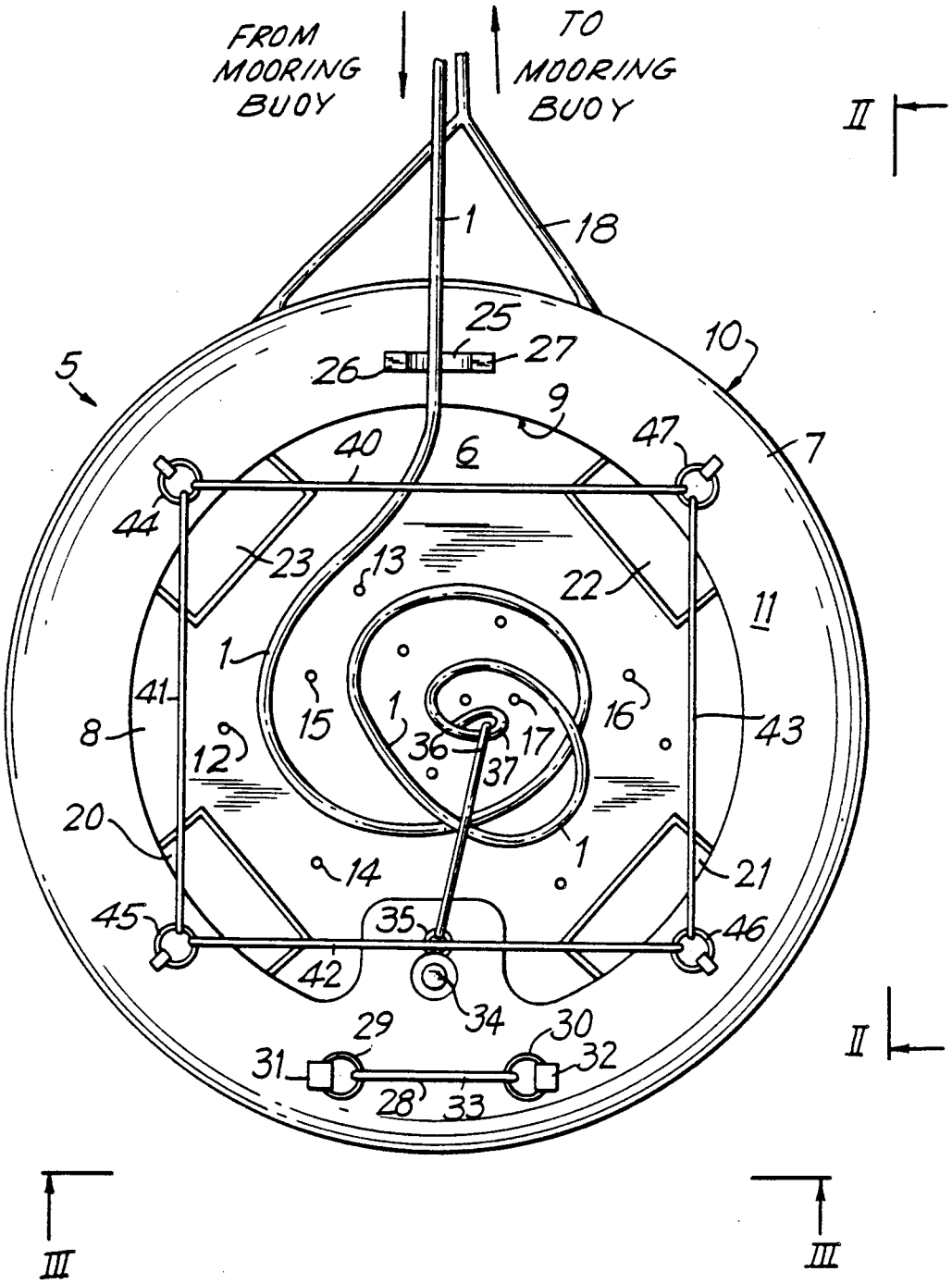
FIG. 1 is a top plan view of an embodiment of the mooring line flotation device of the invention.

The mooring line flotation device of the invention maintains a mooring line 1 (FIGS. 1 and 2) extending from an offshore structure or buoy 2 (FIG. 2) above the surface 3 of a body of water 4 (FIG. 2) when said mooring line is not in use (FIGS. 1 and 2).

The flotation device of the invention comprises a raft-like float 5 (FIGS. 1 to 3) having an open center 6 (FIG. 1), a buoyant bordering member 7 (FIGS. 1 to 3) around said center (FIG. 1) and a platform member 8 (FIG. 1) extending across said center above the surface 3 of the body of water 4 when said float is afloat, as shown in FIG. 2.

The float 5 may comprise any suitable known buoyant material or materials. The buoyant bordering member 7 has an inside surface 9 around the center 6 (FIG. 1), an outside surface 10 spaced from and substantially opposite said inside surface (FIG. 1) and an upper surface 11 extending between said inside and outside surfaces (FIG. 1). The buoyant bordering member 7 may comprise any suitable substantially solid buoyant material, such as, for example, cork, styrofoam, or the like, or a chamber and any suitable buoyant gas, such as, for example, air, oxygen, helium, or the like, in the chamber.

The platform member 8 (FIG. 1) is preferably perforated, and may have a plurality of spaced drain holes 12, 13, 14, 15, 16, 17, and so on, formed therethrough, as shown in FIG. 1. The platform member 8 may comprise netting, or the like, or any suitable known substantially water-repellent material such as, for example, rubber or plastic, sufficiently rigid to support the mooring line 1 without distortion of its configuration and constructed in a manner which permits drainage of water therethrough.

A coupling device 18 (FIGS. 1 and 2) is affixed to the outside surface 10 of the buoyant bordering member 7, as shown in FIGS. 1 and 2, and releasably affixes the float 5 to the offshore mooring buoy 2 in close proximity therewith, as shown in FIG. 2. The coupling device 18 may comprise any suitable known harness or bridle arrangement of lines, ropes, rubber cords, cables, or the like.

The platform member 8 encloses the center 6 and is bordered by the inside surface 9, as shown in FIG. 1. Thus, the mooring line 1 extending from the mooring buoy 2 is supported, when not in use in mooring a boat, by the platform member 8 in substantially clean, dry and readily available condition for use when desired, as shown in FIG. 1.

A plurality of pockets 20, 21, 22 and 23 are provided on the inside surface 9 of the buoyant bordering member 7, as shown in FIG. 1, for storing ballast (not shown in the FIGS.). The pockets 20 to 23 may be more or less than four in number and comprise any suitable known material for restraining ballast.

A lead device 25 is mounted on the upper surface 11 of the buoyant bordering member 7 (FIGS. 1 and 2) and comprises any suitable means for directing the mooring line 1 aboard the float 5 in proximity with the coupling device 18, as shown in FIG. 1. A suitable lead device 25 may thus consist of a substantially U-shaped member mounted with its spaced parallel arms 26 and 27 (FIG. 1) extending substantially perpendicularly to the plane of the platform member 8. The mooring line 1 then rests between the arms 26 and 27 of the lead device 25 as said line leaves the float 5.

A grasping member 28 (FIGS. 1 to 3) is affixed to the upper surface 11 of the buoyant bordering member 7 for facilitating the manipulation of the float 5 and thereby the mooring line 1 supported thereby. The grasping member 28 may comprise any suitable known loop for grasping manually or with a gaff or like instrument. A suitable grasping member may thus consist of a pair of rings 29 and 30 (FIGS. 1 and 3) affixed to the float 5 by any suitable members 31 and 32, respectively (FIG. 1), and a rope, cord, cable, line, or the like, 33 mounted on and supported by said rings, as shown in FIG. 1.

Figure 6:
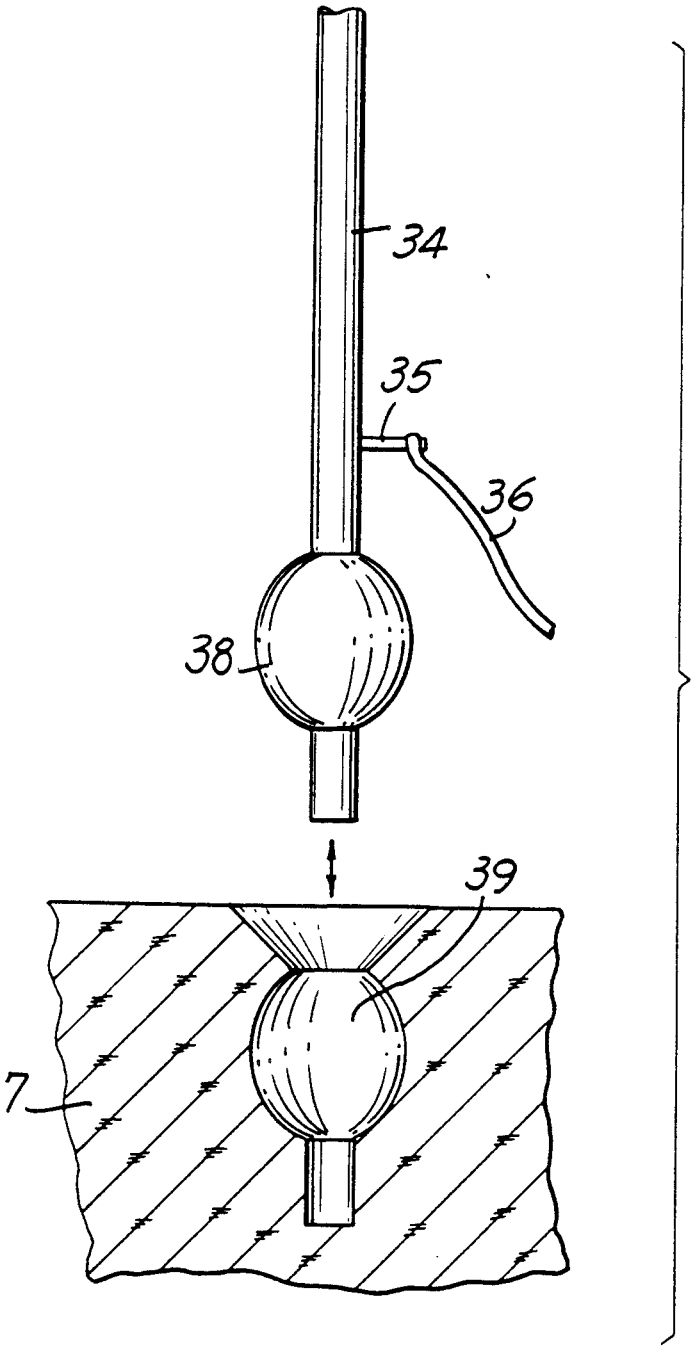
FIG. 6 is a view, partly in section, on an enlarged scale, of the mast of the mooring line flotation device of the invention.

A mast 34 (FIGS. 1 to 3 and 6) is removably mounted on the buoyant bordering member 7 and is coupled or tied by any suitable means, such as, for example, a ring, or the like 35, on said mast (FIGS. 1 and 6) and a rope or cord, or the like, 36 (FIGS. 1 and 6) tied at one end to said ring and at its opposite end to the free end 37 (FIG. 1) of the mooring line 1. The mast 34 is removably mounted on the buoyant bordering member 7 by any suitable known means, such as, for example, a bulbous area 38 (FIG. 6) formed at the base of said mast and extending coaxially with said mast and of greater diameter than said mast and a socket or groove 39 (FIG. 6) formed near the upper surface 11 of said buoyant bordering member in said member for accommodating said bulbous area. This seating arrangement permits the mast 34 to be manually inserted into its socket or groove 39 and manually removed therefrom to permit easy handling of the free end 37 of the mooring line 1, but retains said free end and said mooring line on the float 5 when said line is not in use by normally retaining said mast in a stable, secure, upright position.

A restraining device is utilized to prevent the mooring line 1 on the float 5 from falling into the water. The restraining device comprises, as shown in FIG. 1, a restraining rope or ropes 40, 41, 42 and 43 mounted on the buoyant bordering member 7 by any suitable known means, such as, for example, rings 44, 45, 46 and 47 mounted on said bordering member. The rope or ropes 40, 41, 42, 43 is tied to the rings 44, 45, 46, 47 in a manner whereby they surround the mooring line 1 and function as a restraining device for said mooring line.

Figure 5:
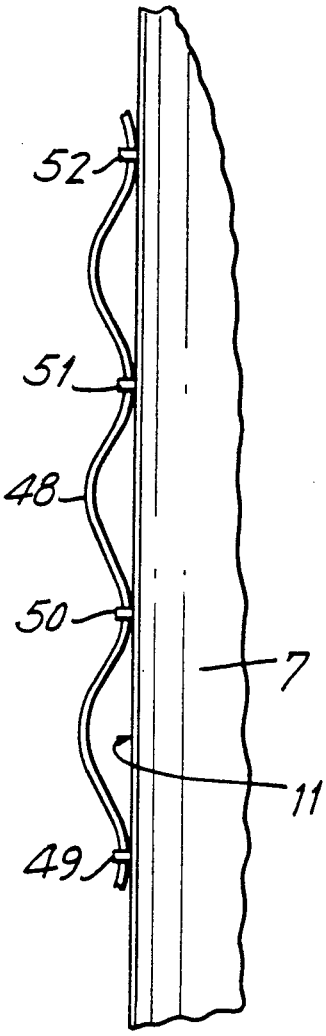
FIG. 5 is a view, taken along the lines V—V, of FIG. 4.

A seagull roost-discouraging device is utilized to prevent seagulls, and the like, from roosting or settling on the float 5. The seagull roost-discouraging device comprises a waterproof rope or cord 48 of any suitable known type, such as, for example, polypropylene, affixed to the upper surface 11 of the buoyant bordering member 7 by any suitable known means, such as, for example, substantially equidistantly spaced "U" tacks, or the like, 49, 50, 51, 52, and so on (FIGS. 4 and 5), in a manner whereby said rope or cord undulates in planes angularly disposed relative to said upper surface; the planes being preferably approximately 90° relative to said upper surface. Seagulls do not generally roost on an undulating rope.

In a preferred embodiment of the mooring line flotation device of the invention, the float 5 consists of a substantially annular gas chamber of any suitable known gas and water-tight material. The gas chamber 5 has an inner diameter surface 9 around the open center 6 (FIG. 1), an outer diameter surface 10 spaced from and substantially radially opposite said inner diameter surface (FIG. 1) and an upper surface 11 extending between said inner and outer diameter surfaces (FIG. 1).

In the preferred embodiment, the coupling device 18 is affixed to the outer diameter surface 10 of the gas chamber 5. The spaced pockets 20, 21, 22 and 23 are on the inner diameter surface 9 of the gas chamber 5 (FIG. 1). The mast 34 is mounted on the gas chamber 5 and the lead device 25 is mounted on the upper surface 11 of said chamber, as shown in FIG. 1. The grasping member 28 is affixed to the upper surface 11 of the gas chamber 5.

Although shown and described in what is believed to be the most practical and preferred embodiment, it is apparent that departures from the specific device described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

I claim:

1. A mooring line flotation device for maintaining a mooring line extending from an offshore structure above the surface of a body of water when the mooring line is not in use, said flotation device comprising a raft-like float having an open center, a buoyant bordering member around said center and a perforated platform member extending across said center above the surface of said body of water when said float is afloat, said buoyant bordering member having an inside surface around said center, an outside surface spaced from and substantially opposite said inside surface and an upper surface extending between said inside and outside surfaces; and coupling means affixed to said float for releasably affixing said float to said offshore structure in close proximity therewith, whereby a mooring line extending from said structure is supported, when not in use, by said platform member in substantially dry and readily available condition for use when desired, said coupling means being affixed to the outside surface of said buoyant bordering member and said platform member enclosing said center and being bordered by said inside surface.

2. A mooring flotation device as claimed in claim 1, wherein said buoyant bordering member comprises substantially solid buoyant material.

3. A mooring line flotation device as claimed in claim 1, wherein said buoyant bordering member comprises a gas chamber and buoyant gas in said chamber.

4. A mooring line flotation device as claimed in claim 1, further comprising pocket means on said bordering member for storing ballast.

5. A mooring line flotation device as claimed in claim 1, further comprising pocket means on said inside surface of said buoyant bordering member for storing ballast.

6. A mooring line flotation device as claimed in claim 1, further comprising a mast removably mounted on said device and a coupling device coupling the free end of said mooring line to said mast.

7. A mooring line flotation device as claimed in claim 1, further comprising lead means mounted on said bordering member for directing said mooring line aboard said flotation device in proximity with said coupling means.

8. A mooring line flotation device as claimed in claim 1, further comprising grasping means affixed to said bordering member for facilitating the manipulation of said flotation device and thereby said mooring line supported thereby.

9. A mooring line flotation device as claimed in claim 1, further comprising restraining means mounted on said bordering member for preventing the mooring line from falling into the water.

10. A mooring line flotation device as claimed in claim 1, further comprising seagull roost-discouraging means mounted on said bordering member.

11. A mooring line flotation device for maintaining a mooring line extending from an offshore structure above the surface of a body of water when the mooring line is not in use, said flotation device comprising a substantially annular gas chamber having an open center and a perforated platform member extending across and enclosing said center above the surface of said body of water when said chamber is afloat, said chamber having an inner diameter surface around said center, an outer diameter surface spaced from and substantially radially opposite said inner diameter surface and an upper surface extending between said inner diameter and outer diameter surfaces;

coupling means affixed to the outer diameter surface of said chamber for releasably affixing said chamber to said offshore structure in close proximity therewith, whereby a mooring line extending from said structure is supported, when not in use, by said platform member in substantially clean, dry and readily available condition for use when desired; and a plurality of spaced pockets on the inner diameter surface of said chamber for storing ballast.

12. A mooring line flotation device as claimed in claim 1, further comprising a mast removably mounted on said device and a coupling device coupling the free end of said mooring line to said mast.

13. A mooring line flotation device as claimed in claim 11, further comprising lead means mounted on the upper surface of said chamber for directing said mooring line aboard said flotation device, in proximity with said coupling means.

14. A mooring line flotation device as claimed in claim 11, further comprising grasping means affixed to the upper surface of said chamber for facilitating the manipulation of said flotation device and thereby said mooring line supported thereby.

15. A mooring line flotation device as claimed in claim 11, further comprising restraining means mounted on said bordering member for preventing the mooring line from falling into the water.

16. A mooring line flotation device as claimed in claim 11, further comprising seagull roost-discouraging means mounted on said bordering member.

* * * * *